US007804248B1

(12) United States Patent
Li et al.

(10) Patent No.: US 7,804,248 B1
(45) Date of Patent: Sep. 28, 2010

(54) LAMP WITH SHAPED WALL THICKNESS, METHOD OF MAKING SAME AND OPTICAL APPARATUS

(75) Inventors: Jim W. Li, San Jose, CA (US); Christopher Kirk, Beaconsfield (GB)

(73) Assignee: KLA-Tencor Technologies Corporation, Milpitas, CA (US)

( * ) Notice: Subject to any disclaimer, the term of this patent is extended or adjusted under 35 U.S.C. 154(b) by 453 days.

(21) Appl. No.: 11/695,425

(22) Filed: Apr. 2, 2007

(51) Int. Cl.
*H01J 61/30* (2006.01)

(52) U.S. Cl. ..... 313/634; 313/631

(58) Field of Classification Search ..... 313/627–634
See application file for complete search history.

(56) References Cited

U.S. PATENT DOCUMENTS 4,636,692 A * 1/1987 Lapatovich et al. ..... 315/248
6,246,170 B1 * 6/2001 Sugawara ..... 313/570
2004/0201353 A1 * 10/2004 Miyazawa ..... 313/634

* cited by examiner

*Primary Examiner*—Nimeshkumar D. Patel
*Assistant Examiner*—Peter R Haderlein
(74) *Attorney, Agent, or Firm*—Joshua D. Isenberg; JDI Patent

(57) ABSTRACT

A lamp, a method of making a bulb for a lamp and an optical apparatus are disclosed. The lamp may include an anode and cathode disposed within a bulb. The bulb may include an optically refractive wall that is rotationally symmetric about an axis. A thickness of the wall may decrease with increase in azimuthal angle between an equatorial plane of the bulb and a point on the bulb's surface. The apparatus may include the lamp and an ellipsoidal reflecting surface. An alternative apparatus may include an ellipsoidal reflecting surface and a lamp having an anode and cathode within a bulb. A gap between the anode and cathode may be proximate a focus of the reflecting surface. The bulb may include an optically refractive wall configured such that a 0.24/0.13 NA power ratio for bulb light coupled to the interior ellipsoidal reflecting surface is between about 3.0 and about 3.3.

9 Claims, 7 Drawing Sheets

LAMP WITH SHAPED WALL THICKNESS, METHOD OF MAKING SAME AND OPTICAL APPARATUS

FIELD OF THE INVENTION

This invention generally relates to a broadband light source and more particularly to an arc lamp having its thickness shaped for controlling pupil illumination profile.

BACKGROUND OF THE INVENTION

Broadband light sources are used for various applications in the semiconductor processing industry. These applications include wafer inspection systems and lithography systems. In both types of systems it is desirable for the light source to have a long useful lifetime, high brightness and a broad spectral range of emitted light. Currently plasma-based light sources are used in lithography and wafer inspection systems. Plasma-based light sources generally include an enclosure containing a cathode, an anode and a discharge gas, e.g., argon, xenon, or mercury vapor or some combination of these. A voltage between the cathode and anode maintains a plasma or electric arc.

Broadband light sources often find use in semiconductor wafer inspection tools and steppers. In such tools, light from the plasma or arc may be collected with an ellipsoidal mirror and focused into the end of a light pipe. In wafer inspection tools, defect detection is sensitive to the angle of incidence of light depending on the type of defect. It is desirable, therefore, for illumination from the light pipe to provide a proper range of incident angles. Sometimes the distribution of incident angles (referred to sometimes as the pupil fill) is non-uniform or less than ideal.

It is within this context that embodiments of the present invention arise.

BRIEF DESCRIPTION OF THE DRAWINGS

Other objects and advantages of the invention will become apparent upon reading the following detailed description and upon reference to the accompanying drawings in which.

DESCRIPTION OF THE SPECIFIC EMBODIMENTS

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

Introduction

Figure 1A:
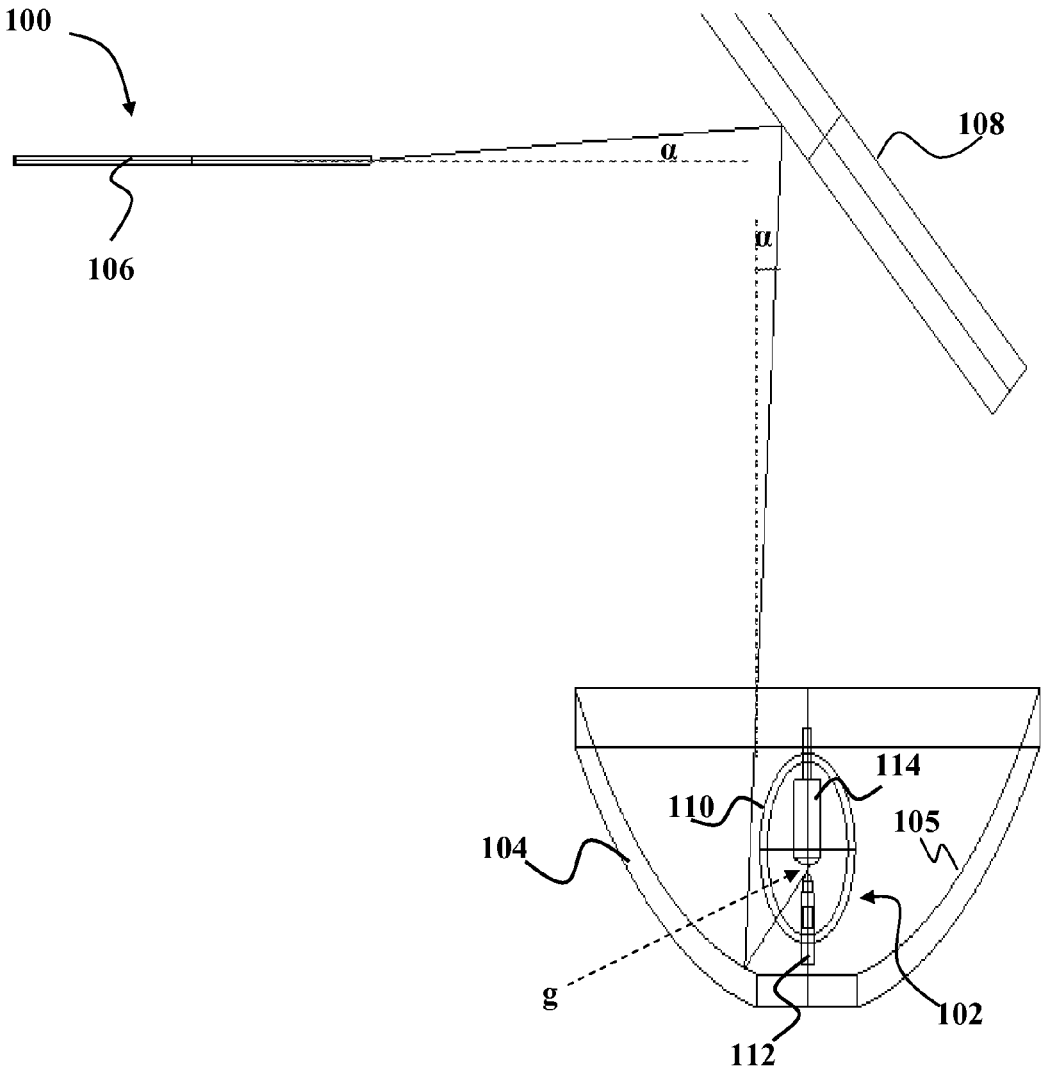
FIG. 1A is a cross-sectional schematic diagram of an optical apparatus according to an embodiment of the present invention.

The nature of the problem solved by embodiments of the invention may be understood with respect to FIG. 1A, which depicts a portion of an optical apparatus 100 commonly used for semiconductor wafer inspection. The relevant portion of the apparatus 100 includes a lamp 102, a reflector 104. The reflector 104 has an ellipsoidal interior reflecting surface 105. A light pipe 106 may be optically coupled to the ellipsoidal reflector 104, e.g., through a mirror 108. The inner surface and the outer surface of the ellipsoidal reflector 104 are ellipsoidal in shape and concentric with respect to each other. The lamp 102 includes a transparent bulb 110 that houses a source of illumination. The bulb 110 includes a wall made of an optically refractive material. By way of example, the lamp may be an arc discharge lamp having a cathode 112 and anode 114 separated by a gap g. A sufficiently high voltage applied between the cathode and anode causes an electrical discharge, e.g., a plasma or arc to be generated in the gap g. The bulb 110 may be filled with a gas such as Mercury or Xenon that enhances optical output from the discharge at a desired range of wavelengths.

Figure 1B:
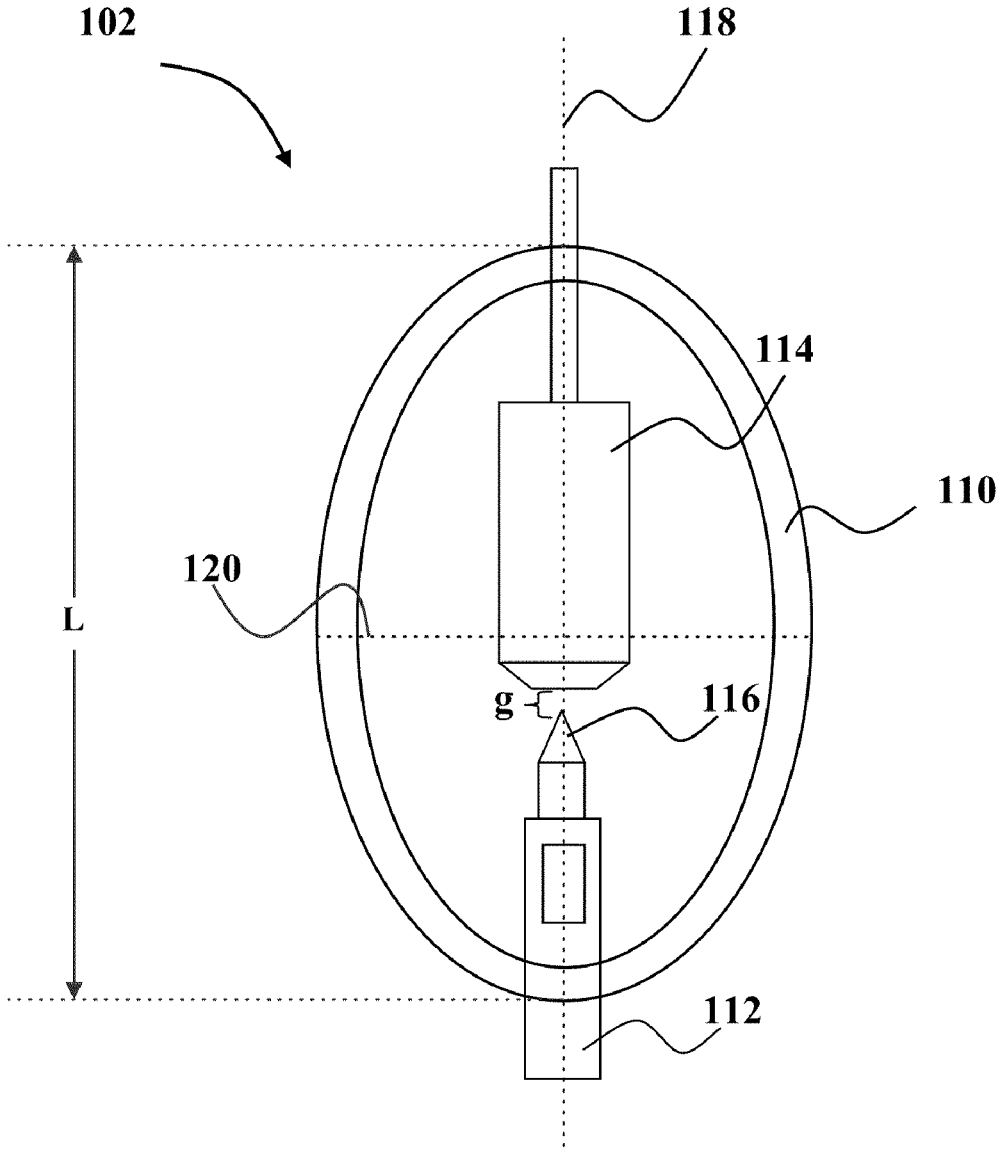
FIG. 1B is a cross-sectional schematic diagram of a lamp described in FIG. 1A FIGS. 2A-2B are partial cross-sectional schematic diagrams of the optical apparatus of FIG. 1A illustrating the effect of bulb shape on pupil fill.

The gap g is located proximate of focus of the ellipsoidal reflector 104. An entrance to the light pipe may be located at the other focus (or an optical equivalent). It is desirable that light from the discharge illuminates the light pipe over a sufficient range of numerical aperture values. As used herein, numerical aperture refers to the sine of the vertex angle of a cone of meridional rays that can enter or leave an optical system or element, multiplied by the refractive index of the medium in which the vertex of the cone is located. A meridional ray generally refers to a ray that lies in a plane that contains the optical axis. For example, if light from the reflector strikes the entrance of the light pipe 106 at an angle $\alpha$ relative to an optical axis of the light pipe 106 the numerical aperture for this ray is given by $NA=\sin(\alpha)$. Numerical aperture is related to the angle of incidence for light emerging from a far end of the light pipe 106. FIG. 1B illustrates the lamp 102 of the optical apparatus 100 as described in FIG. 1A. The cathode 112 is rotationally symmetric about an axis 118. The bulb has a length L measured along the axis 118. If the bulb is symmetric with respect to the equatorial plane, the distance between the equatorial plane 120 and the end of the bulb is L/2.

By way of example, and without loss of generality, the diameter of the bulb 110 may be approximately, 38 millimeters at the equatorial plane. The cathode 112 may have a diameter of about 0.5 millimeters.

Obtaining a proper pupil fill over a sufficient range of numerical aperture values depends partly on the geometry of the cathode. Light from certain portions of the discharge will be blocked by the cathode and will not contribute to optical power at a corresponding value of numerical aperture. The cathode 112 may include a conical surface 116 at an end proximate the equatorial plane 120. By way of example, the vertex angle of the conical surface 116 may be about 60 degrees. The vertex of the conical surface 116 may be about 6 millimeters from the equatorial plane. In certain embodiments of the present invention, proper numerical aperture ratios may be obtained by appropriate variation of the thickness of the bulb 110.

Figure 2A:
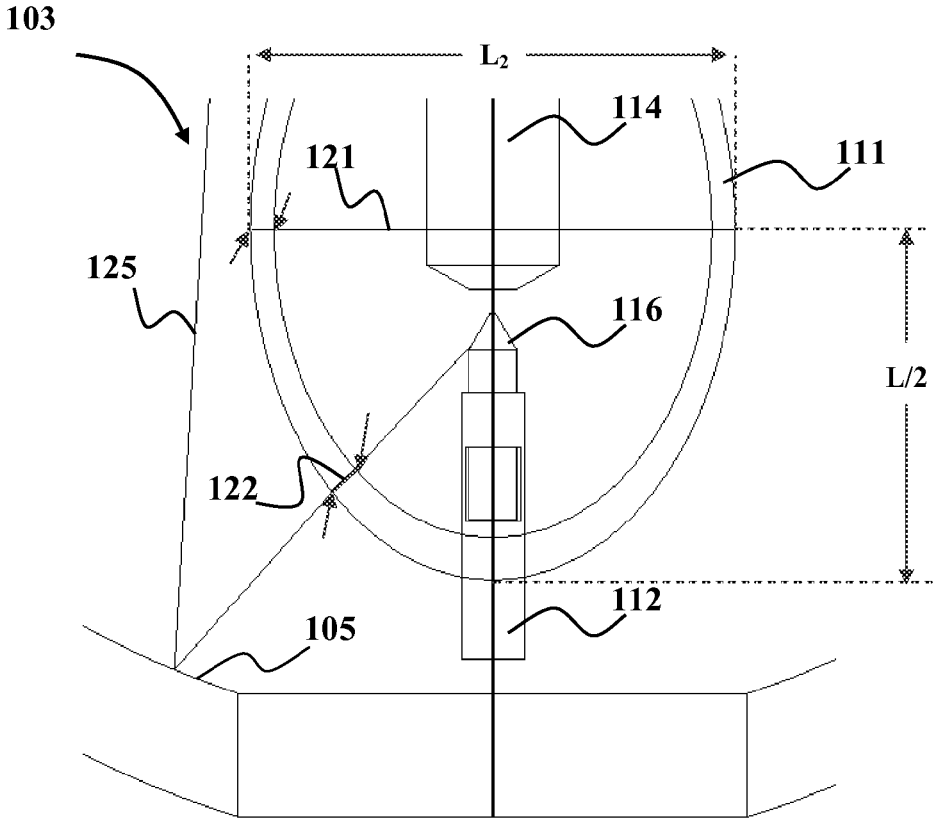

The nature of the problem is illustrated in FIG. 2A, which depicts a portion of the apparatus 100 as described in FIG. 1A. As shown in FIG. 2A, a lamp 103, which is similar to the lamp 102 described in FIGS. 1A and 1B, includes a bulb 111 having a wall thickness that is thinner at the center and increases with increase in an azimuthal angle between an equatorial plane of the bulb and a point on a surface of the bulb. The bulb has a width of $L_2$ measured along an axis perpendicular to the axis 118. By way of example, the thickness of the wall of the bulb 111 may be about 1.9 mm at an equatorial plane 121. The wall thickness may increase to about 2.9 mm at a cathode cutoff 122, which is located at an intersection between the wall and a line of sight along the conical surface of the cathode. As shown in FIG. 2A a 0.12 NA ray is blocked by cathode 116. As a result, the 0.12 NA ray 125 cannot contribute to pupil fill. Consequently a loss of light at low NA results if the bulb wall is thinner at the center.

Figure 2B:
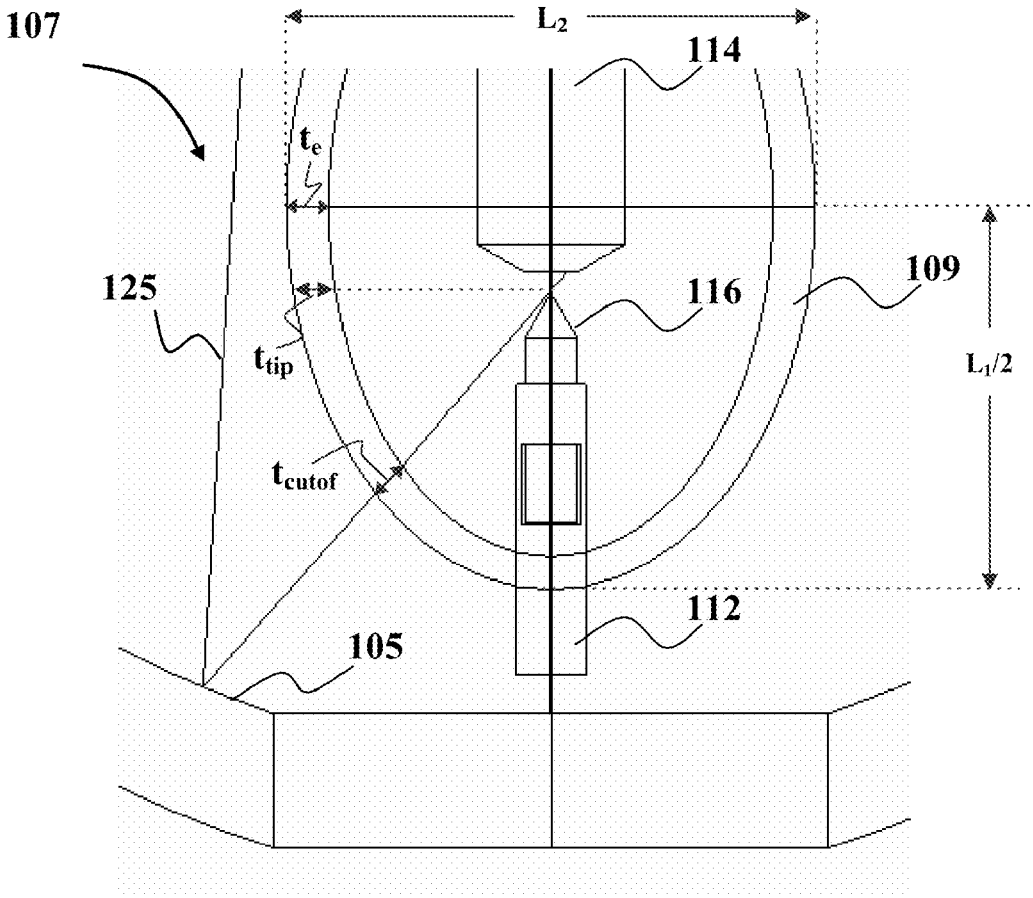

FIG. 2B depicts a portion of the apparatus 100 according to an embodiment of the present invention. As shown in FIG. 2B, the lamp 107, which is also a type of lamp 102 as described in FIGS. 1A and 1B, includes a bulb 109 having the thickness of the wall decreasing with increase in an azimuthal angle between an equatorial plane of the bulb and a point on a surface of the bulb. Typically, the wall of the bulb 109 is thickest proximate the equatorial plane. A thickness $t_{cutoff}$ of the wall at a cathode cutoff is between about 0.8 and about 0.9 times a thickness $t_e$ of the wall at the equatorial plane. For example, the thickness $t_e$ of the wall at the equatorial plane may be about 3.1 mm and the thickness $t_{cutoff}$ at the cathode cutoff may be about 2.7 mm. As shown in FIG. 2B, ray is refracted upward and passes through arc so that 0.22 NA ray 125 can contribute to pupil fill. The thickness and shape of the wall are selected such that a 0.24/0.13 NA power ratio for light from the bulb that is coupled to the interior reflecting surface 105 of the reflector 104 is between about 3.0 and about 3.3. 0.24/0.13 NA power ratio refers to a ratio of optical power at 0.24 NA to optical power at 0.13 NA. The desired pupil fill may be obtained by properly matching the optical behavior of the bulb 109 to the optical behavior of the reflector 104. It is noted that in some cases, a substantially uniform bulb thickness or even a wall thickness that increases with azimuthal angle may provide the desired pupil fill.

Figure 3A:
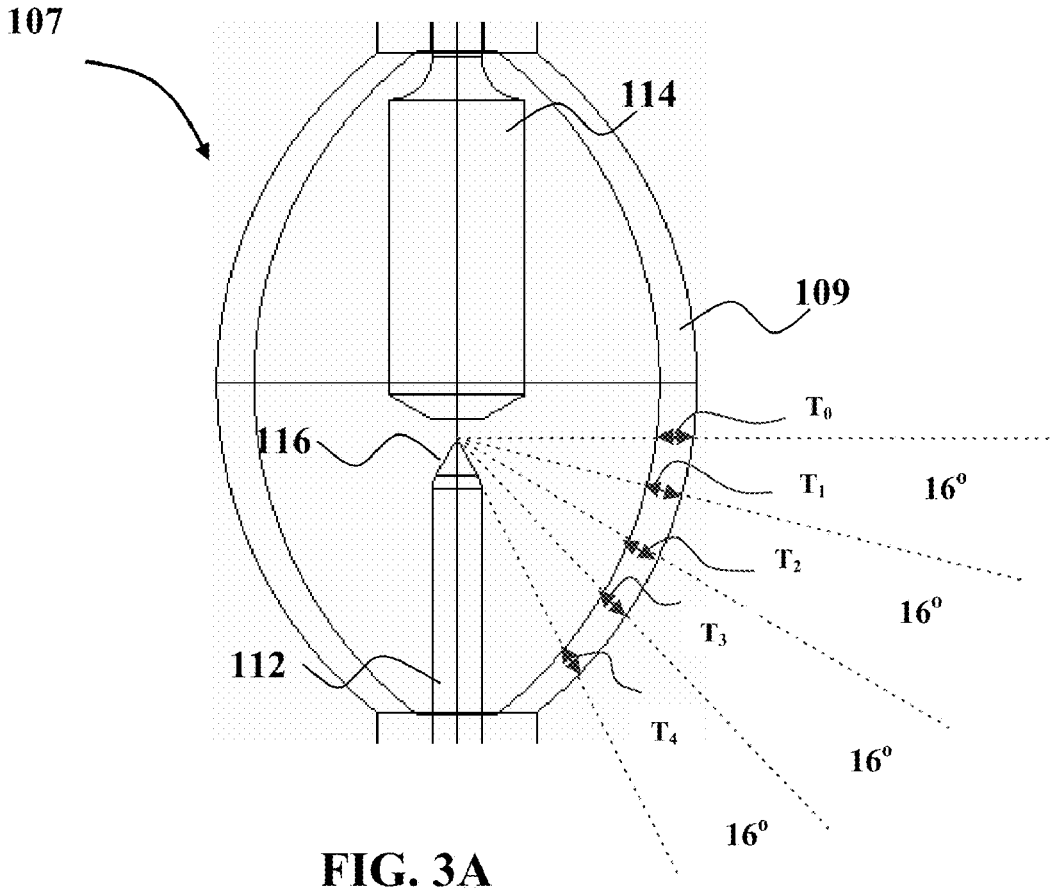
FIG. 3A is a schematic diagram of a lamp according to an embodiment of the present invention.
Figure 3B:
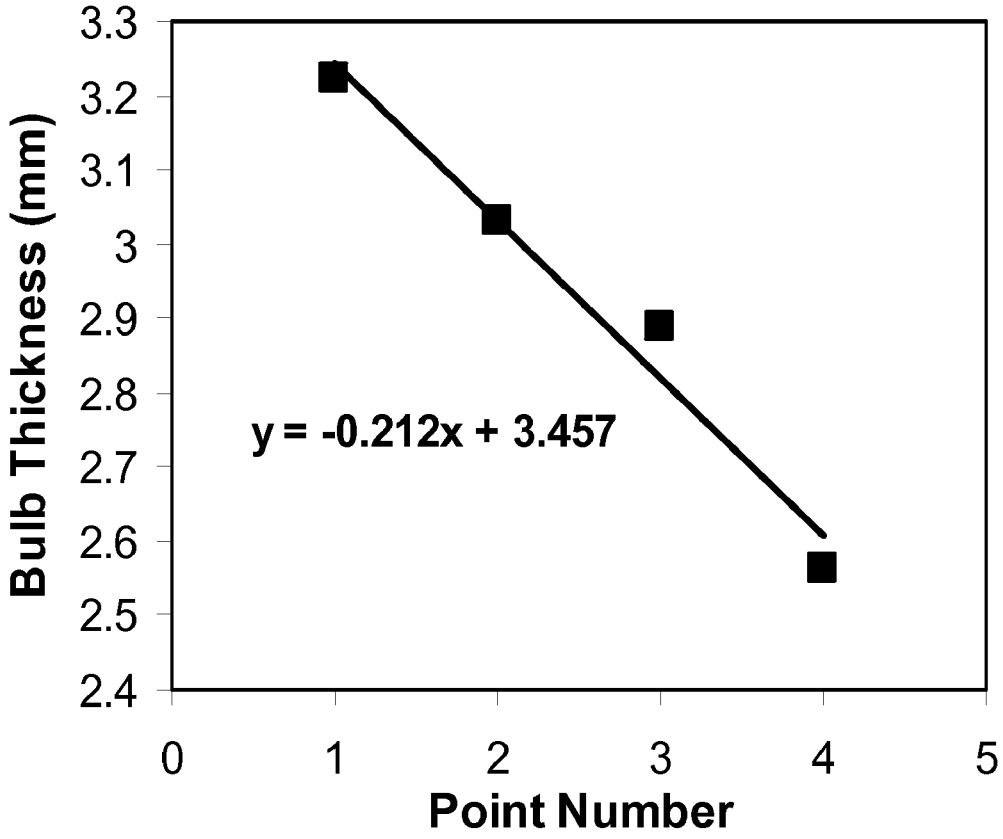
FIG. 3B is a plot defining a fitting line derived from the thickness ratio of four different points described in FIG. 3A

FIG. 3A is a schematic diagram of a lamp illustrating the specification of the thickness of the bulb's wall according to an embodiment of the present invention. As shown in FIG. 3A, the thickness of the wall between the cathode cutoff and an apex plane perpendicular to the axis and aligned with an apex of the conical surface of the cathode is derived. Five locations on the bulb 109 envelope of the lamp 107 are defined by extending lines originating from the cathode 116 tip. These lines are oriented at 16° with respect to each other. The thicknesses $T_1$, $T_2$, $T_3$ and $T_4$ are measured from the intercept points of the lines with the inner wall and the outer wall of the bulb 109. A plot of thickness vs. data point and fit a straight line to data (LSF): Y=AX+B is shown in FIG. 3B, where Y is the thickness of the wall, X is a quantity proportional to an azimuthal angle measured relative to the apex plane and A and B are constants. For an optimization of the pupil illumination of the lamp, A<−CB may be derived from a ratio of the thickness of the wall $t_{cutoff}$, e.g., $T_4$, at a cathode cutoff and a thickness of the wall $t_{tip}$, e.g., $T_0$, at a plane perpendicular to a rotational symmetry axis of the bulb that intersects the cathode at the tip. After analysis of the performance of different bulbs it may be empirically determined that a ratio $t_{cutoff}/t_{tip}$ must be less than or equal to some value, e.g., 0.82 in order to have acceptable pupil fill.

For example, the wall thickness Y(0) at cathode tip (X=0) may be given by Y(0)=A*0+B=B. The thickness Y(4) at the cathode cut-off (X=4) may be given by Y(4)=A*4+B. E.g., where the ratio $Y(4)/Y(0)=t_{cutoff}/t_{tip}\leqq 0.82$, we have (4A+B)/B<=0.82, from which we derive A<=−0.045B or C=0.045.

The deviation of any point from the fitting line may be given by: $T_i-Y_i<\pm 0.25A$ (i=1 . . . 4).

In this example, a quartz bulb has been assumed. The focusing properties may be somewhat dependent on the material of the bulb. These effects may be taken into account when designing the bulb. Fortunately, the changes in pupil fill become noticeable only when index is changed by >50% or more compared to the value initially used for the bulb design. In addition, the gas inside the bulb may be neglected when determining the focusing properties of the bulb.

Figure 4:
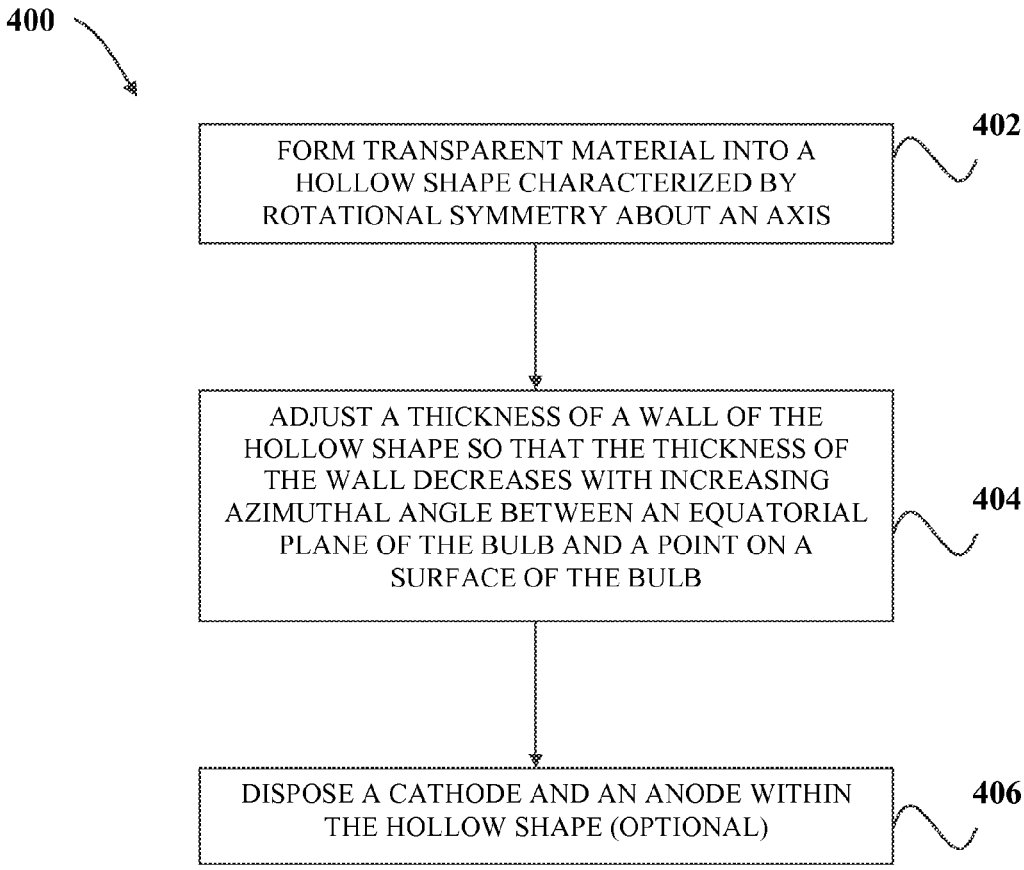
FIG. 4 is a flow diagram illustrating a method of making a bulb according to an embodiment of the present invention.

FIG. 4 is a flow diagram illustrating a method 400 for making a bulb for a lamp of the type depicted in FIGS. 1A-1B. As indicated in 402, a transparent material, such as fused silica, is formed into a hollow shape characterized by rotational symmetry about an axis, which can be done by blow molding the transparent material. The thickness of the wall of the hollow shape is adjusted so that a thickness of the wall decreases with increasing azimuthal angle between an equatorial plane of the bulb and a point on a surface of the bulb, wherein the equatorial plane is substantially perpendicular to the axis as indicated in 404. The thickness of the wall is adjusted by controlling the temperature of the transparent material and a rate at which gas is blown into the hollow shape during blow molding.

At 406, a cathode and an anode are disposed within the hollow shape. The cathode and the anode are separated by a gap having a center of symmetry aligned with the axis of the hollow shape. The cathode includes a conical surface at an end proximate the equatorial plane and is rotationally symmetric about the axis of the hollow shape. Thickness of a wall of the hollow shape is adjusted such that the thickness $t_{cutoff}$ at a cathode cutoff is between about 0.8 and about 0.9 times a thickness $t_e$ of the wall at the equatorial plane. The thickness of the wall between the cathode cutoff and an apex plane perpendicular to the axis and aligned with an apex of the conical surface may vary approximately as Y=Ax+B, where Y is the thickness of the wall, x is a quantity proportional to an azimuthal angle measured relative to the apex plane and A and B are constants.

Experiments demonstrating advantages of bulbs manufactured as described above have been performed. In an apparatus of the type shown in FIG. 1A, the 0.24/0.13 NA power ratio was measured for six different lamps having bulbs with different thickness profiles. The bulbs were approximately ellipsoidal in shape with the major axis corresponding to the axis of the cathode and anode. Each bulb had an eccentricity (ratio of major axis $L_1$ to minor axis $L_2$ of the exterior of the bulb) of about 1.55. Each bulb was approximately circularly symmetric about the major axis. The major axis of the bulb was aligned with the major axis of an ellipsoidal reflector having an eccentricity of 0.85. The ratio of the major axis of the reflector to the major axis of the bulb was about 87. The gap between the cathode and anode of the bulb was located approximately at a focus of the reflector. Bulb thickness at a cathode cutoff $t_{cutoff}$ and at a cathode tip $t_{tip}$ were measured using both X-ray analysis and optical comparator analysis.

The results are shown in Table I below:

| | X-Ray Analysis | | Optical Comparator Analysis | | 0.24/0.13 NA power |
|---|---|---|---|---|---|
| LAMP | $t_{tip}/L_2$ | $t_{cutoff}/t_{tip}$ | $t_{tip}/L_2$ | $t_{cutoff}/t_{tip}$ | ratio |
| A | 0.150 | 0.92 | 0.164 | 0.77 | 3.26 |
| B | 0.148 | 0.85 | 0.167 | 0.68 | 3.02 |
| C | 0.155 | 0.85 | 0.172 | 0.79 | 3.09 |
| D | 0.137 | 1.04 | 0.154 | 1.09 | 4.03 |
| E | 0.144 | 1.02 | 0.163 | 0.99 | 3.58 |
| F | 0.144 | 1.10 | 0.161 | 1.00 | 3.98 |

As may be seen from Table I, bulbs A, B and C had a ratio $t_{cutoff}/t_{tip}$ between about 0.8 and about 0.9 produced a 0.24/

0.13 NA power ratio in a desired range between about 3.0 and about 3.3. Bulbs D, E, and F, by contrast, had higher $t_{cutoff}/t_{tip}$ ratios and produced unacceptably large values of 0.24/0.13 NA power ratio.

Embodiments of the present invention allow for better pupil fill in optical apparatus that use lamps with glass bulbs as a light source. Although in the preceding discussion, discharge lamps were discussed, those of skill in the art will recognize that the same principles may also be applied to incandescent lamps and other light sources having transparent bulbs.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature, whether preferred or not, may be combined with any other feature, whether preferred or not. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. An optical apparatus, comprising:

a reflector characterized by an interior ellipsoidal reflecting surface; and an arc lamp having an anode and a cathode disposed within a transparent bulb, wherein a gap between the anode and cathode is located proximate a focus of the interior ellipsoidal reflecting surface, wherein the bulb includes a wall made of an optically refractive material, wherein a thickness and shape of the wall are configured such that a 0.24/0.13 Numerical Aperture (NA) power ratio for light from the bulb that is coupled to the interior ellipsoidal reflecting surface is between about 3.0 and about 3.3.

2. The apparatus of claim 1, wherein a thickness of the wall varies with respect to an azimuthal angle between an equatorial plane of the bulb and a point on a surface of the bulb.

3. The apparatus of claim 2 wherein the thickness of the wall decreases with increasing azimuthal angle, whereby the bulb is thickest proximate the equatorial plane.

4. The apparatus of claim 1 wherein the wall and the cathode are rotationally symmetric about an axis.

5. The apparatus of claim 1 wherein the cathode includes a conical surface at an end proximate the equatorial plane and wherein a thickness of the wall at a cathode cutoff is between about 0.8 and about 0.9 times a thickness of the wall at the equatorial plane, wherein the cathode cutoff is located at an intersection between the wall and a line of sight along the conical surface.

6. The apparatus of claim 5 wherein the thickness of the wall between the cathode cutoff and an apex plane perpendicular to the axis and aligned with an apex of the conical surface varies approximately as $Y=Ax+B$, where Y is the thickness of the wall, x is a quantity proportional to an azimuthal angle measured relative to the apex plane and A and B are constants, wherein A is a negative number.

7. The apparatus of claim 6 wherein an actual wall thickness T for a given value of x varies from the value of Y by an amount less than about ±0.25A.

8. The apparatus of claim 1 wherein the wall is made of fused silica.

9. The apparatus of claim 1 wherein an inner surface of the wall and an outer surface of the wall are ellipsoidal in shape and concentric with respect to each other.

* * * * *